US006079756A

United States Patent [19]

Phillips

[11] Patent Number: 6,079,756

[45] Date of Patent: Jun. 27, 2000

[54] OVEN DOOR LATCH

[75] Inventor: Bryan T. Phillips, Dayton, Ohio

[73] Assignee: Whirlpool Corporation, Benton Harbor, Mich.

[21] Appl. No.: 09/014,550

[22] Filed: Jan. 28, 1998

[51] Int. Cl.[7] ..... E05C 3/06

[52] U.S. Cl. ..... 292/198; 292/229; 292/333; 292/DIG. 69; 292/203

[58] Field of Search ..... 126/197, 194; 292/DIG. 72, DIG. 69, 332, 333, 194, 216, 229, 195, 198, 202, 203, 129, 95, 207, DIG. 15; 70/121

[56] References Cited

U.S. PATENT DOCUMENTS

| | | | |
|---|---|---|---|
| 10,460 | 3/1884 | Mix | 292/333 |
| 1,090,305 | 3/1914 | Hoffman | 292/333 |
| 1,518,643 | 12/1924 | Faubert | 292/198 |
| 2,246,793 | 6/1941 | Dall | 292/198 |
| 2,274,711 | 3/1942 | Krause | 292/198 |
| 2,572,630 | 10/1951 | Krause | 292/198 |
| 2,729,487 | 1/1956 | Krause et al. | 292/99 |
| 2,910,859 | 11/1959 | Allen et al. | 292/207 X |
| 4,163,443 | 8/1979 | Peterson | 126/197 |
| 4,593,945 | 6/1986 | Arute et al. | 292/201 |
| 4,825,027 | 4/1989 | Yoon | 219/10.55 |
| 4,838,586 | 6/1989 | Henne | 292/113 |
| 4,861,078 | 8/1989 | Munoz | 292/113 |
| 5,419,305 | 5/1995 | Hanley | 126/197 |
| 5,477,030 | 12/1995 | Buckshaw et al. | 219/413 |

*Primary Examiner*—Teri Pham

*Attorney, Agent, or Firm*—Stephen D. Krefman; Joel M. Van Winkle; Robert O. Rice

[57] ABSTRACT

A latch mechanism for use with an oven having a door, the latch mechanism including a base plate which pivotably supports a latch member about a pivot point. The latch member is rotatable between a latched and unlatched position and includes a drive surface offset from the pivot point. An actuator pin is supported by the base plate for rectilinear movement wherein the actuator pin has an outer end extending beyond the base plate for engaging the oven door upon closure and an inner end drivingly engaging the drive surface for rotating the latch member into a latched position against a spring bias. The base plate is a molded plastic member having a boss including snap connection means for rotatably supporting the latch member and a sleeve for slidingly supporting the actuator pin for rectilinear movement. A solenoid is mounted to the base plate and has a locking pin selectably movable between an extended position and a retracted position. When the latch member is in a latched position, movement of the locking pin into the extended position places the locking pin in interference with the rotation of the latch member such that the latch mechanism is locked into the latched position. Two switches mounted to the base plate are positioned to sense when the latch member is in a latched position or in a locked state.

16 Claims, 3 Drawing Sheets

OVEN DOOR LATCH

BACKGROUND OF THE INVENTION

1. Field of the Invention

The present invention relates to oven door latches and more particularly, to oven door latches usable in combination with a self-cleaning oven or range.

2. Description of Related Art

It is well known to provided ovens with latch mechanisms which can be locked to prevent accidental or inadvertent opening of an oven door. Such latch mechanisms are especially useful in self-cleaning ovens where it is desirable to prevent opening of the oven door during the high-temperature self-cleaning cycle. While a number of types of oven door latching mechanisms have been developed over the years, in general they have all attempted to provide a means for rotating a latch arm into locking engagement with the oven door.

One type of oven door latching mechanism is illustrated by U.S. Pat. No. 3,367,697, to Fox. The user of the appliance in the Fox reference must manually move an actuating handle to engage and latch the door in a closed position before initiating the self-cleaning cycle of the oven. An obvious disadvantage to this type of system is the inconvenience and cost associated with employing an actuating handle to rotate the latch arm into a latched position.

Other oven latching mechanisms use electrically operated drive means such as motors or solenoids to drive a latch arm into locking engagement with an oven door. U.S. Pat. No. 5,477,030, to Buckshaw et al., discloses an oven door latch mechanism which uses an electrothermal drive means to rotate a latch arm into locking engagement with an oven door. Electrically operated drive means are relatively costly and raise concerns of reliability.

Another type of latching mechanism for an oven door is exemplified by U.S. Pat. No. 4,163,443, to Peterson. This reference discloses a mechanism which has eliminated the need for a handle or electrical drive means to latch the oven door but instead uses a latch bolt which moves longitudinally while simultaneously rotating upon engagement with a latch pin on the oven door. Subsequent to the latching operation, the latch is locked in its retracted position by a thermally responsive interlock for preventing the latch from opening during the self-cleaning cycle of the oven. While the Peterson mechanism eliminates the need for a handle or electrical drive means, it is relatively costly and complex due to the need to support the latch bolt to allow both longitudinal and rotational movement.

U.S. Pat. No. 4,593,945, to Arute et al., discloses an oven latch assembly similar to the Peterson reference. In Arute et al., the oven latch has a latch bolt which is mounted for rotational movement and subsequent longitudinal movement to a latched position. The latch bolt moves responsive to engagement with a latch pin provided on the oven door. A door sensing element is cooperatively engaged with the latch bolt to prevent accidental tripping of the latching mechanism when the oven door is not properly positioned. Like Peterson, Arute et al. is relatively costly and complex wherein both the latch bolt and the door sensing element engage the oven door upon closure.

In view of the disadvantages of the above described references, it would be an improvement in the art to provide a latching mechanism in which the latch arm rotates to a latched position without use of a manually operated handle, electrical drive means or direct contact between the latch arm and the oven door. Moreover, it would be an advantage to provide a latching mechanism which is easy to assemble and relatively inexpensive.

SUMMARY OF THE INVENTION

It is an object of the invention to provide an oven door latch mechanism which utilizes the energy of the closing oven door to rotate a latch arm into a latched position.

It is another object to provide an oven door latch which has the advantages of low cost and few parts and simple design including a plastic base plate for mounting the latch mechanism components thereto.

It is another object of the invention to provide a door latch mechanism which can be locked by moving a locking pin into an interference position with the latch arm such that the latching mechanism can be locked using a relatively low power actuator.

It is still a further object of the invention to provide an oven latch which forms an integral assembly which can be snap connected together in a manner which requires few if any fasteners such that the latch mechanism is easy to assemble.

According the present invention, the foregoing and other objects are attained by a latch mechanism or safety latch for use with an oven having a door wherein the safety latch moves to a latched position in response to closure of the oven door. The latch mechanism includes a base plate which pivotably supports a latch member about a pivot point. The latch member is rotatable between a latched and unlatched position. The latch member includes a drive surface offset from the pivot point.

An actuator pin is supported by the base plate for rectilinear movement wherein the actuator pin has an outer end extending beyond the base plate for engaging the oven door upon closure and an inner end drivingly engaging the drive surface for rotating the latch member into a latched position. A spring, supported by the base plate adjacent the latch member, biases the latch member to pivot toward the unlatched position such that the actuator pin rotates the latch member into the latched position against the spring bias.

The base plate is a molded plastic member having a boss including snap connection means for rotatably supporting the latch member and a sleeve for slidingly supporting the actuator pin for rectilinear movement.

A solenoid is mounted to the base plate and has a locking pin selectably movable between an extended position and a retracted position. When the latch member is in a latched position, movement of the locking pin into the extended position places the locking pin in interference with the rotation of the latch member such that the latch mechanism is locked into the latched position.

DESCRIPTION OF THE PREFERRED EMBODIMENT

Figure 1:
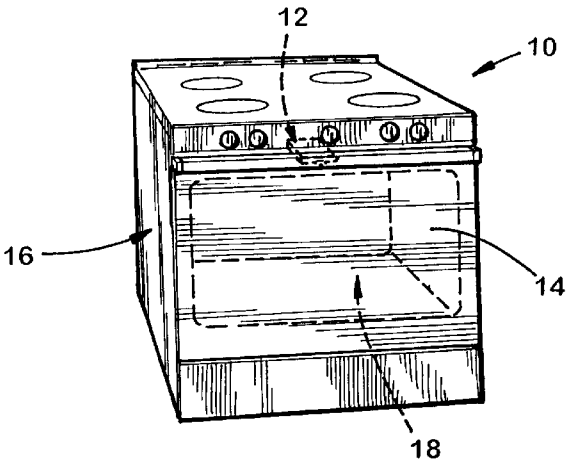
FIG. 1 is a perspective view of an oven embodying a door latch mechanism of the present invention.

FIG. 1 illustrates an oven 10 embodying a door latch mechanism 12. The oven 10 includes a door 14 hinged at its bottom to a frame or cabinet 16. The frame 16 of the oven is disposed about an oven chamber 18. The door 14 closes at an interface formed by an inner surface 20 (FIG. 2) of the door 14 and an abutment surface of the oven frame 16.

Figure 2:
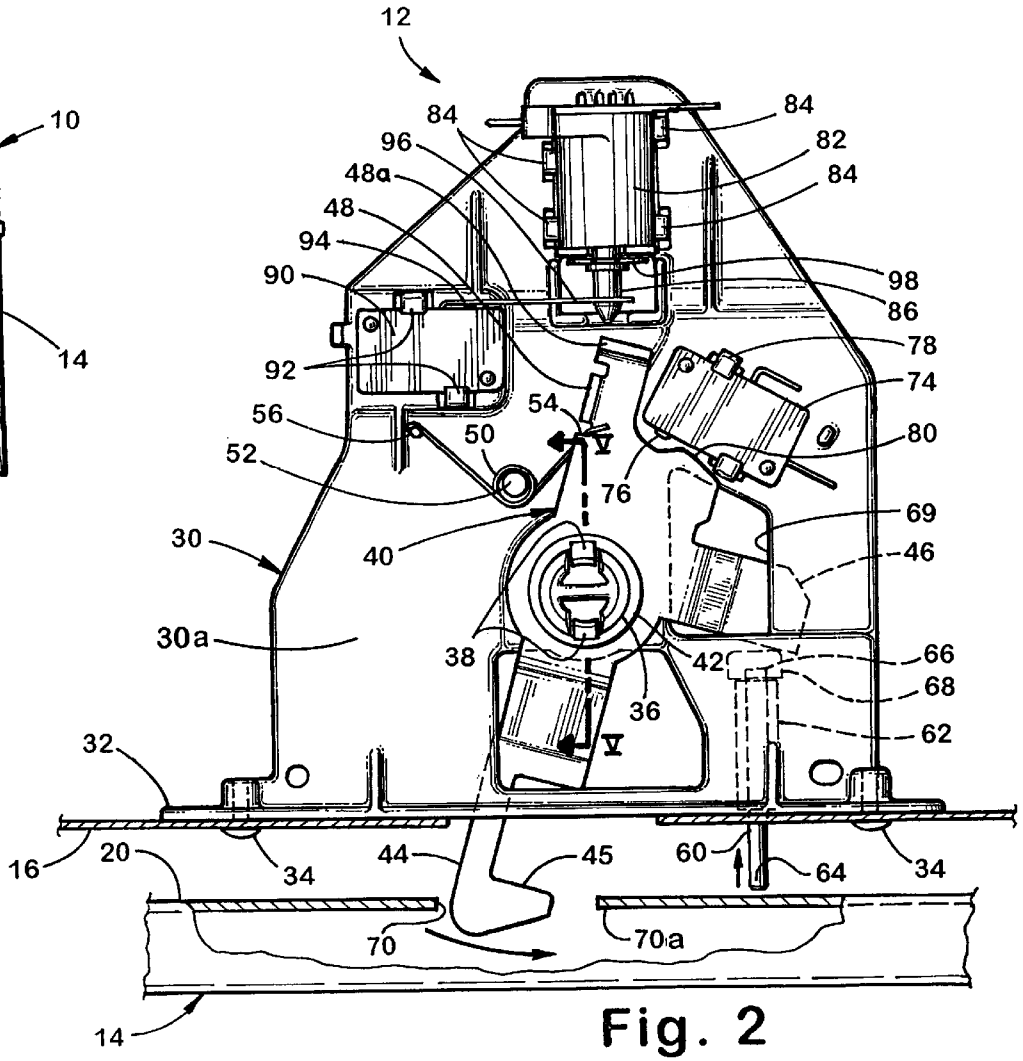
FIG. 2 is a plan view of the latch mechanism of the present invention with the oven door open and the latch mechanism in an unlatched position.
Figure 3:
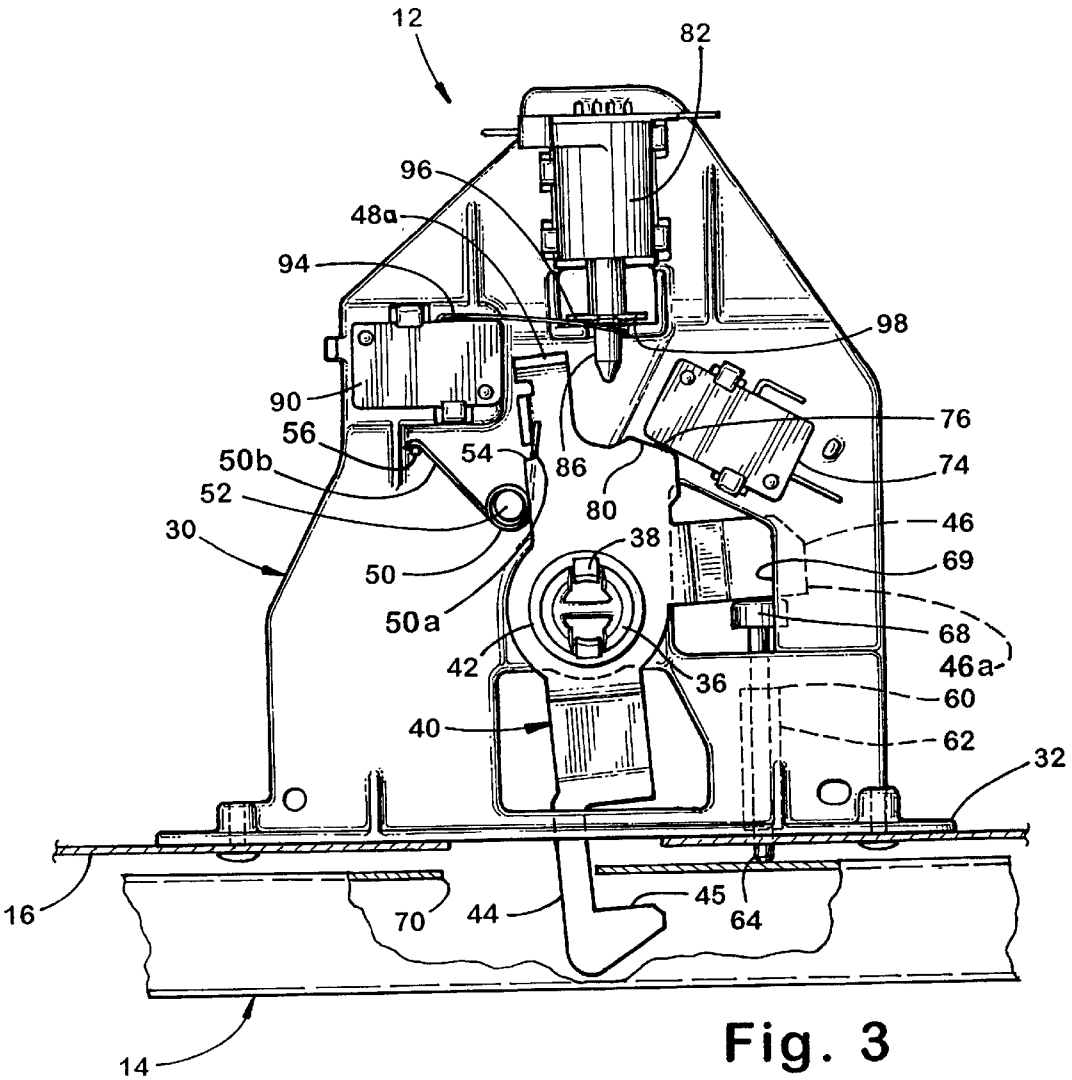
FIG. 3 is a plan view of the latch mechanism of the present invention with the oven door closed and the latch mechanism in a latched position.
Figure 4:
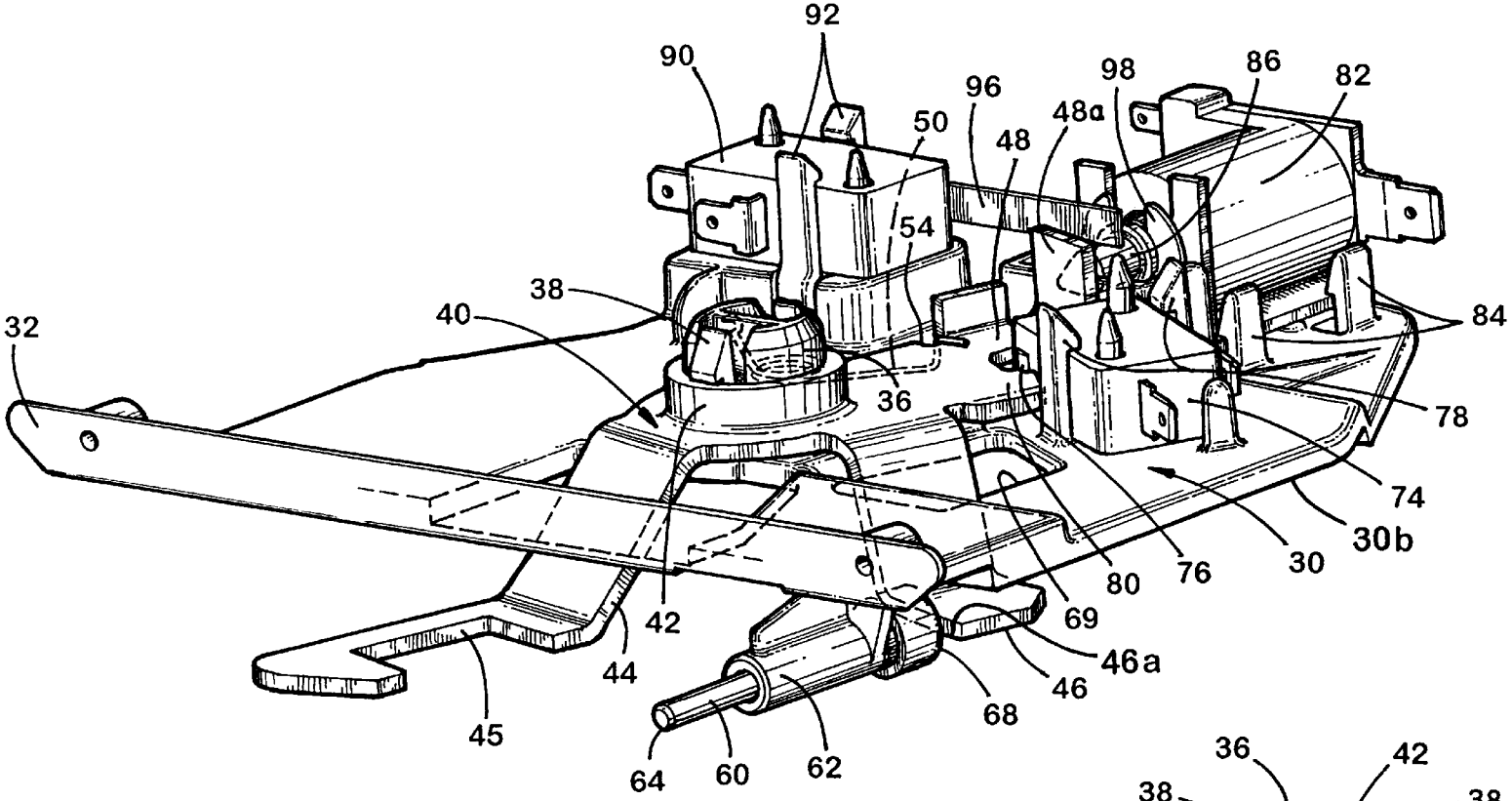
FIG. 4 is a perspective view of the latch mechanism of the present invention of FIG. 1.

Referring now to FIG. 2–4, the latch mechanism is viewed from above with overlying parts of the oven omitted for clarity. The latch mechanism 12 includes a base plate 30 which is preferably a plastic member having a plurality of snap connection means for securing the components of the latch mechanism 12 to the base plate 30. The base plate 30 is a generally planar member having a top surface 30*a* and a bottom surface 30*b*. The base plate 30 is disposed above the oven chamber 18 and includes a front flange 32 which is secured to the frame 16 via fasteners 34.

The base plate 30 pivotably supports a latch member 40 about a boss 36 for movement between an open or unlatched position, shown in FIG. 2, and a closed or latched position shown in FIG. 3. The latch member 40 is preferably a stamped metallic member and includes a flanged central opening 42. The latch member 40 further includes a latch arm 44, a drive arm 46 and a locking arm 48 all generally extending radially outward from the central opening 42. The latch arm 44 of the latch member 40 includes a cut-out portion 45 and extends outwardly beyond the front flange 32 through an opening in the frame 16 toward the oven door 14. The drive arm 46 extends generally perpendicular to the latch arm 44 and includes a drive surface 46*a*. The locking arm 48 includes an upturned end portion 48*a*.

Figure 5:
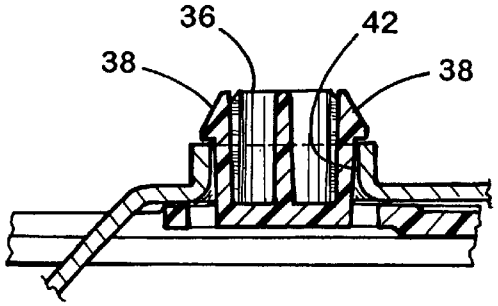
FIG. 5 is a enlarged, sectional view taken along line V—V of FIG. 2.

The latch member 40 is pivotably connected to the base plate 30 by inserting the boss 36 having snap lock fingers 38 through the central opening 42, as best seen in FIG. 5. A coil spring 50 is disposed about a pivot pin 52 extending from the top surface 30*a* of the base plate 30. The spring 50 has one end portion 50*a* seated in a notch 54 provided on the latch member 40 and the other extending end portion 50*b* abutting against an upstanding pin 56. The spring 50 acts to bias the latch member to rotate about the boss 36 in a clockwise direction as viewed in FIG. 2. As an alternative embodiment, the coil spring 50 may be replaced by a leaf spring having a base portion which snap connects to the base plate 30.

The latching mechanism 12 is uniquely configured such that the latch member 40 is rotated by an actuator pin 60 in response to the closure of the door 14. The actuator pin 60 is supported for rectilinear movement within a sleeve 62 integrally molded and extending from the bottom surface 30*b* of the base plate 30. The actuator pin 60 is preferably a metallic member having an outer end 64 extending beyond the front flange 32 of the base plate 30 and further having an inner end 66 about which is formed a contact button 68. The drive arm 46 extends through an opening 69 in the base plate 30 such that the drive surface 46*a* is biased into engagement with the contact button 68 of the actuator pin 60 by the spring 50.

When the oven door 14 is open, the spring 50 biases the latch member 40 to rotate clockwise until the contact between the drive arm 46, contact button 68 and sleeve 62 interfere with further rotation. In this orientation, the latch member 40 is in an unlatched position. FIG. 2 illustrates the locking mechanism 12 in an unlatched position at the point of initial contact between the oven door 14 and the actuator pin 60 before the door is fully closed. At this point, the inner surface 20 of the door 14 engages the outer end 64 of the actuator pin 60 while the latch arm 44 is received into a latch opening 70 provided in the inner surface 20. As the door 14 continues to a fully closed position under the urgings of the door springs (not shown), the actuator pin 60 is pushed inwardly such that the contact button 68 drives the drive arm 46 causing the latch member 40 to rotate in a counterclockwise direction. FIG. 3 illustrates the door 14 in fully closed position wherein the actuator pin 60 has rotated the latch member 40 such that the latch arm 44 is disposed in a latched position wherein the peripheral edge or latch surface 70*a* of the latch opening 70 is received into the cut-out portion 45 of the latch arm 44.

It can be understood, therefore, that the actuator pin 60 operates to rotate the latch member 40 into a latched position every time the oven door 14 is closed. In a like manner, when the oven door is opened, movement of the door 14 allows the actuator pin 60 to move outwardly wherein the latch member 40 is allowed to rotate, in response to the bias of spring 50, to an unlatched position.

The latch mechanism 12 further includes means which are capable of sensing when the oven door is closed. A door switch 74 is supported along the top surface 30*a* of the base plate 30 via snap connect arms 78. The switch 74 has a contact button 76 which must be depressed to close the switch 74 to enable current flow therethrough. The switch 74 is oriented such that when the latch member 40 is in an unlatched position, the contact button 76 is not depressed. However, when the latch member 40 rotates to the latched position, a protruding portion 80 of the latch member 40 contacts the contact button 76 such that the switch 74 is closed.

During high temperature operation of the oven, such as during a self clean cycle, it is necessary to lock the latch mechanism 12 such that the oven door 14 is locked into a closed position. To that end, an actuator or actuation means such as a solenoid 82 is mounted to the base plate 30 adjacent the locking arm 48 of the latch member 40 via snap connect arms 84. The solenoid 82 has a locking pin 86 selectably movable between a retracted position (FIG. 2) and an extended position (FIG. 3). While the actuator can be of any known type, such as a electrothermal drive means (wax motor) or motor, the disclosed solenoid 82 is preferably a magnetic latching type solenoid which responds to a short burst of energy to change states between having the locking pin positioned in the retracted position and the extended position.

When the latch is not locked, the locking pin 86 is positioned in its retracted position wherein the latch member is allowed free, unimpeded rotation. In this position, the oven door can be freely opened and closed wherein the latch member 40 freely rotates between its unlatched and its latched position. If the solenoid 82 is energized for extending the locking pin 86 when the latch mechanism is in an unlatched position, the end portion of the locking arm 48 interferes with the extension of the locking pin.

When the latch mechanism 12 is in its latched position, the latch mechanism 12 can be locked by moving the locking pin 86 into its extended position for interfering with the arc of rotation of the upturned end portion 48*a* of the locking arm 48. With the locking pin 86 in its extended position, when the operator attempts to pull open the door 14, the rotation of the latch member 40 to an unlatched position is impeded by the interference between the locking arm 48 and the locking pin 86 such that the latch arm 44 can not rotate clear of the latch surface 70*a* of the door 14. Accordingly, the latch member 40 is locked in a latched position wherein the latch arm 44 is disposed in a latched position and the latch surface 70*a* of the door 14 is received into the cut-out portion 45 of the latch arm 44, preventing the oven door 14 from opening.

A clean enabling or lock switch 90 is supported along the top surface 30*a* of the base plate 30 via snap connect arms 92. The lock switch 90 has a contact button 94 which must be depressed to close the switch 90 to enable current to flow therethrough. Mounted to the lock switch 90 is an elongated arm 96 which extends therefrom to a point adjacent the locking pin 86. When the locking pin 86 is moved to its extended position, a shoulder 98 on the locking pin 86 engages the elongated arm 96 such that the contact button 94 is depressed. In this manner, the lock switch 90 senses when the latch mechanism 12 is locked.

It can be seen from the foregoing specification and attached drawings that the oven door latch mechanism of the present invention provides a simple and effective way to latch an oven door in a closed position. To close the latch mechanism 12 an actuator pin 60 rotates the latch mechanism to a latched position. To lock the latch mechanism 12 a locking pin 86 is extended into an interference position with the latch mechanism. The use of a plastic base plate 30 as a platform for all of the latch components results in a latch mechanism which is easy to assemble. Moreover, the latch member 40 is a unitary member but acts to serve a plurality of functions.

While the present invention has been described with reference the above described embodiments, those of skill in the Art will recognize that changes may be made thereto without departing from the scope of the invention as set forth in the appended claims.

I claim:

1. An automatic latch mechanism for use with an oven having a door, the latch mechanism comprising:

a base plate;

a latch member pivotably mounted to the base plate about a pivot point and rotatable between an unlatched and latched position, the latch member including a drive surface offset from the pivot point; and an actuator pin movably supported by the base plate, the actuator pin having an outer end extending beyond the base plate for engaging the oven door upon closure and an inner end drivingly engaging the drive surface for rotating the latch member into the latched position wherein the door is adapted to be captured by the latch member, wherein the base plate is a molded plastic member having a boss including snap connection means for rotatably supporting the latch member and a sleeve for slidingly supporting the actuator pin for rectilinear movement.

2. An automatic latch mechanism for use with an oven having a door, the latch mechanism comprising:

a base plate;

a latch member pivotably mounted to the base plate about a pivot point and rotatable between an unlatched and latched position, the latch member including a drive surface offset from the pivot point;

an actuator pin movably supported by the base plate, the actuator pin having an outer end extending beyond the base plate for engaging the oven door upon closure and an inner end drivingly engaging the drive surface for rotating the latch member into the latched position wherein the door is adapted to be captured by the latch member; and an electrical actuator mounted to the base plate, the actuator having a locking pin selectably movable into an extended position when the latch member is in a latched position for interfering with the rotation of the latch member such that the latch member is locked into the latched position for locking the oven door in a closed position.

3. The latch mechanism according to claim 2, further wherein the actuator is a magnetic latching type solenoid.

4. The latch mechanism according to claim 2, further wherein:

the latch member includes a locking surface; and the locking pin is selectably movable into an extended position adjacent the locking surface when the latch member is in the latched position such that rotation of the latch member is prevented.

5. The latch mechanism according to claim 2, further comprising:

a lock switch having a contact button and an elongated arm extending therefrom, the elongated arm having an outer end disposed adjacent the locking pin such that the contact button is depressed when the locking pin is in its extended position.

6. An automatic latch mechanism for use with an oven having a door, the latch mechanism comprising:

a base plate;

a latch member pivotably mounted to the base plate about a pivot point and rotatable between an unlatched and latched position, the latch member including a drive surface offset from the pivot point, the latch member includes a protrusion;

an actuator pin movably supported by the base plate, the actuator pin having an outer end extending beyond the base plate for engaging the oven door upon closure and an inner end drivingly engaging the drive surface for rotating the latch member into the latched position wherein the door is adapted to be captured by the latch member; and a door switch mounted to the base plate and having a contact button, wherein the protrusion of the latch member engages and moves the contact button when the latch member is rotated to the latched position.

7. A latch mechanism for use with an oven door having a latch surface, the latch mechanism comprising:

a base plate;

a latch member pivotably mounted to the base plate, the latch member including:

a latch arm extending beyond the base plate, the latch arm having a cut-out portion, a drive arm having a drive surface offset from the pivot point, and a locking arm having a locking surface;

an actuator pin supported by the base plate for rectilinear movement, the actuator pin having an outer end extending beyond the base plate for engaging the oven door upon closure and an inner end drivingly engaging the drive surface for rotating the latch member into a latched position wherein the cut-out portion of the latch arm is adapted to receive the latch surface; and an electrical actuator mounted to the base plate, the actuator having a locking pin selectably movable into an extended position adjacent the locking surface when the latch member is in the latched position such that the latch mechanism is locked in the latched position for locking the oven door in a closed position.

8. The latch mechanism according to claim 7, further wherein the latch member has a protrusion portion, the latch mechanism further comprising:

a door switch having a contact button wherein the protrusion portion of the latch member engages and moves the contact button when the latch member is rotated to the latched position.

9. The latch mechanism according to claim 7, further wherein:

the base plate is a molded plastic member having a boss including snap connection means for rotatably supporting the latch member, a plurality of snap connection means for engaging the actuator and the door switch, and a sleeve for slidingly supporting the actuator pin.

10. The latch mechanism according to claim 7, further comprising:

a spring supported by the base plate for biasing the latch member to pivot toward the unlatched position such that the actuator pin rotates the latch member into the latched position against the spring bias.

11. A latch mechanism for use with an oven having a door which includes a latch surface, the latch mechanism comprising:

a base plate;

a latch member pivotably mounted to the base plate and rotatable between an unlatched and latched position, the latch member including:

a latch arm extending beyond the base plate, the latch arm having a cut-out portion for capturing the latch surface of the door when the latch mechanism is in a latched position, and a drive surface offset from the pivot point; and an actuator pin movably supported by the base plate, the actuator pin having an outer end extending beyond the base plate for engaging the oven door upon closure and an inner end drivingly engaging the drive surface for rotating the latch member into the latched position; and an electrical actuator mounted to the base plate, the actuator having a locking pin selectably movable into an extended position when the latch member is in a latched position for interfering with the rotation of the latch member such that the latch member is locked into the latched position for locking the oven door in a closed position.

12. The latch mechanism according to claim 11, further wherein:

the base plate is a molded plastic member having:

a boss including snap connection means for rotatably supporting the latch member, a sleeve for slidingly supporting the actuator pin for rectilinear movement, and snap connection means for capturing the actuator.

13. The latch mechanism according to claim 11, further wherein:

the latch member includes a locking arm having a locking surface, and the locking pin is selectably movable between a retracted position and an extended position adjacent the locking surface when the latch member is in the latched position such that rotation of the latch member is prevented.

14. The latch mechanism according to claim 13, further comprising:

a lock switch disposed adjacent the locking pin for sensing when the locking pin is in its extended position.

15. The latch mechanism according to claim 11, further comprising:

means for sensing when the latch member is in a latch position.

16. The latch mechanism according to claim 11, further comprising:

means for biasing the latch member to pivot toward the unlatched position such that the actuator pin rotates the latch member into the latched position against a spring bias.

* * * * *